US006182743B1

(12) United States Patent
Bennett et al.

(10) Patent No.: US 6,182,743 B1
(45) Date of Patent: Feb. 6, 2001

(54) POLYHEDRAL ARRAY HEAT TRANSFER TUBE

(75) Inventors: Donald L. Bennett, Franklin, KY (US); Liangyou Tang, Cottontown, TN (US)

(73) Assignee: Outokumpu Cooper Franklin Inc.

( * ) Notice: Under 35 U.S.C. 154(b), the term of this patent shall be extended for 0 days.

(21) Appl. No.: 09/184,187

(22) Filed: Nov. 2, 1998

(51) Int. Cl.[7] ..... F28F 13/18; F28F 1/20; F28F 1/30

(52) U.S. Cl. ..... 165/133; 165/181; 165/182

(58) Field of Search ..... 165/133, 177, 165/179, 181, 183, 182

(56) References Cited

U.S. PATENT DOCUMENTS

| | | | | |
|---|---|---|---|---|
| 4,402,459 | | 9/1983 | Berry | 239/186 |
| 4,658,892 | * | 4/1987 | Shinohara et al. | 165/133 |
| 4,660,630 | | 4/1987 | Cunningham et al. | 165/133 |
| 4,733,698 | * | 3/1988 | Sato | 165/179 |
| 5,010,643 | | 4/1991 | Zohler | 29/890.048 |
| 5,052,476 | | 10/1991 | Sukumoda et al. | 165/133 |
| 5,054,548 | | 10/1991 | Zohler | 165/133 |
| 5,070,937 | * | 12/1991 | Mougin et al. | 165/133 |
| 5,259,448 | * | 11/1993 | Masukawa et al. | 165/179 |
| 5,332,034 | * | 7/1994 | Chang et al. | 165/133 |
| 5,458,191 | * | 10/1995 | Chang et al. | 165/133 |
| 5,513,699 | | 5/1996 | Menze et al. | 165/133 |
| 5,669,441 | | 9/1997 | Spencer | 165/184 |
| 5,682,946 | | 11/1997 | Schmidt et al. | 165/133 |
| 5,697,430 | | 12/1997 | Thors et al. | 165/133 |
| 5,704,424 | | 1/1998 | Kohno et al. | 165/184 |
| 5,975,196 | * | 11/1999 | Gaffaney et al. | 165/133 |
| 6,098,420 | * | 8/2000 | Furukawa et al. | 165/133 |

FOREIGN PATENT DOCUMENTS

522985B1 12/1996 (EP) .

OTHER PUBLICATIONS

Menze, Klaus W., "Review of Patents in Europe, Japan, and the U.S. (1993–1994)," Journal of Enhanced Heat Transfer 1996, vol. 3, No. 1, pp. 1–13.

* cited by examiner

*Primary Examiner*—Ira S. Lazarus
*Assistant Examiner*—Tho Duong
(74) *Attorney, Agent, or Firm*—Hodgson Russ Andrews Woods & Goodyear LLP

(57) ABSTRACT

A heat exchanger tube having an internal surface that is configured to enhance the heat transfer performance of the tube. The internal enhancement has a plurality of polyhedrons extending from the inner wall of the tubing. The polyhedrons have first and second planar faces disposed substantially parallel to the polyhedral axis. The polyhedrons have third and fourth faces disposed at an angle oblique to the longitudinal axis of the tube. The resulting surface increases the internal surface area of the tube and the turbulence characteristics of the surface, and thus, increases the heat transfer performance of the tube.

16 Claims, 2 Drawing Sheets

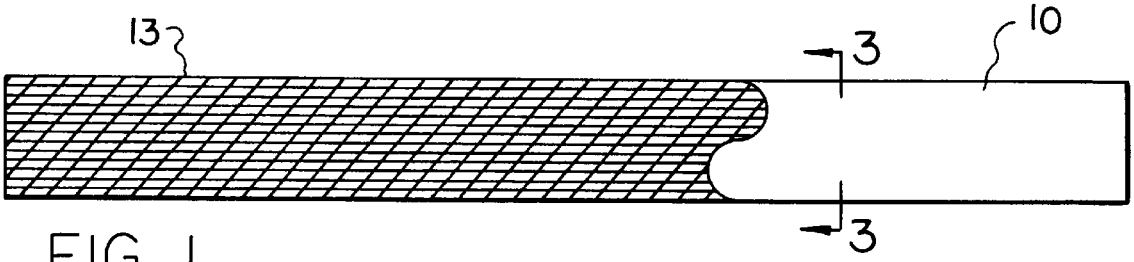
FIG. 1
FIG. 2
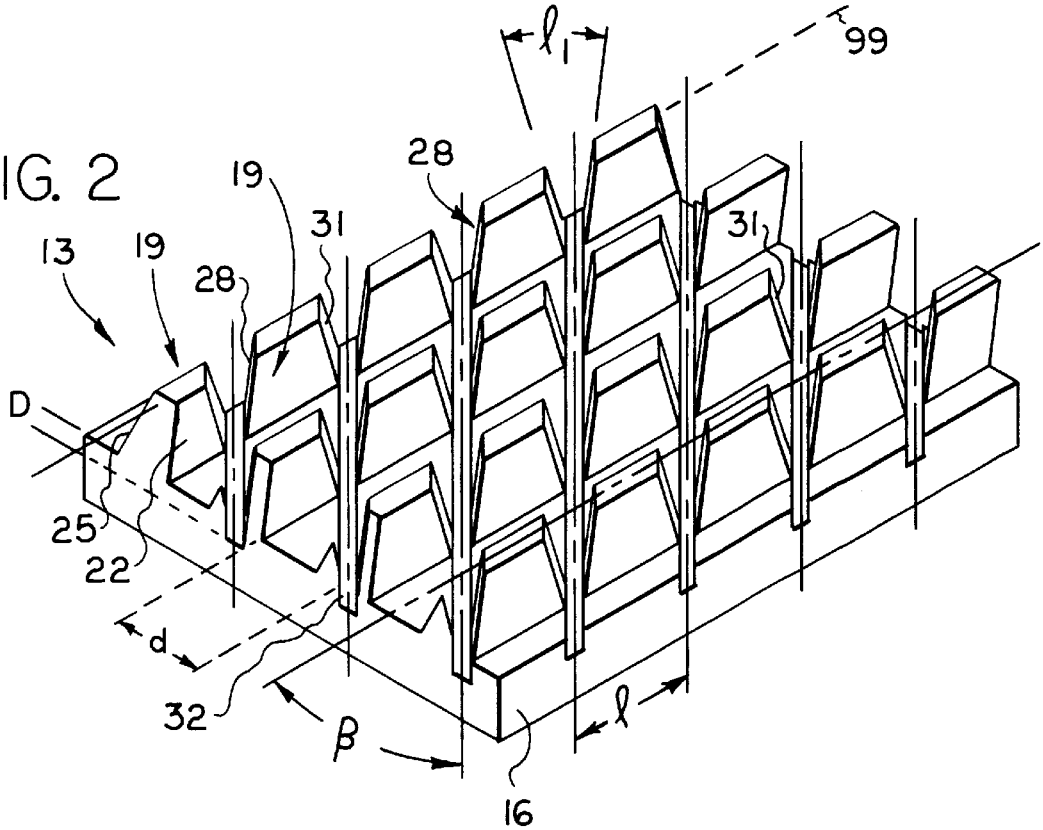
FIG. 3
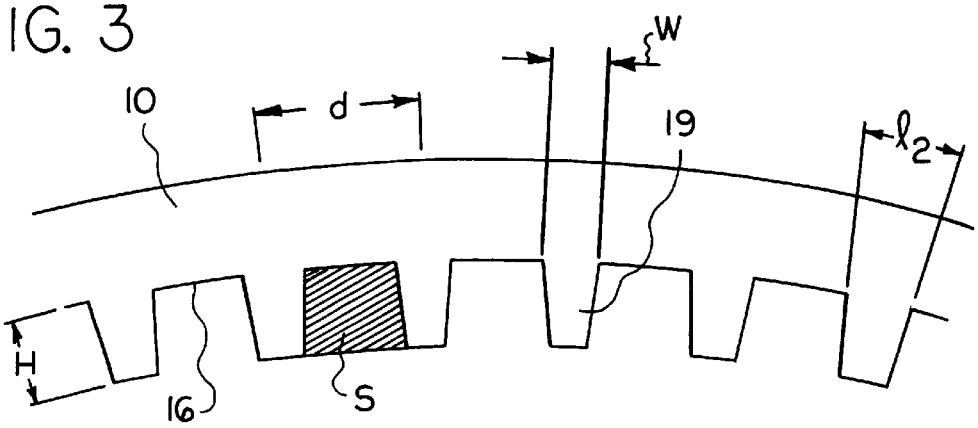

POLYHEDRAL ARRAY HEAT TRANSFER TUBE

FIELD OF THE INVENTION

This invention relates to tubes used in heat exchangers and more particularly, the invention relates to a heat exchanger tube having an internal surface that is capable of enhancing the heat transfer performance of the tube.

BACKGROUND OF THE INVENTION

The heat transfer performance of a tube having surface enhancements is known by those skilled in the art to be superior to a plain walled tube. Surface enhancements have been applied to both internal and external tube surfaces, including ribs, fins, coatings, and inserts, and the like. All enhancement designs attempt to increase the heat transfer surface area of the tube. Most designs also attempt to encourage turbulence in the fluid flowing through or over the tube in order to promote fluid mixing and break up the boundary layer at the surface of the tube.

A large percentage of air conditioning and refrigeration, as well as engine cooling, heat exchangers are of the plate fin and tube type. In such heat exchangers, the tubes are externally enhanced by use of plate fins affixed to the exterior of the tubes. The heat exchanger tubes also frequently have internal heat transfer enhancements in the form of modifications to the interior surface of the tube.

In a significant proportion of the total length of the tubing in a typical plate fin and tube air conditioning and refrigeration heat exchanger, the refrigerant exists in both liquid and vapor states. Below certain flow rates and because of the variation in density, the liquid refrigerant flows along the bottom of the tube and the vaporous refrigerant flows along the top. Heat transfer performance of the tube is improved if there is improved intermixing between the fluids in the two states, e.g., by promoting drainage of liquid from the upper region of the tube in a condensing application or encouraging liquid to flow up the tube in a wall by capillary action in evaporating application.

It is also desirable that the same type of tubing be used in all of the heat exchangers of a system. Accordingly, the heat transfer tube must perform satisfactorily in both condensing and evaporating applications.

In order to reduce the manufacturing costs of the heat exchangers, it is also desirable to reduce the weight of the heat transfer tube while maintaining performance.

Accordingly, what is needed is a heat transfer tube that provides suitable performance for both condensing and evaporating applications and that offers practical and economical features to end users.

SUMMARY OF THE INVENTION

The heat exchanger tube of the present invention meets the above-described needs by providing a tube with features that enhance the heat transfer performance such that, at equal weight, the tube provides heat transfer performance superior to the prior art tubes and, at a reduced weight, the tube provides heat transfer performance equal to the prior art tubes and pressure drop performance that is superior to the prior art tubes.

The heat exchanger tube of the present invention has an internal surface that is configured to enhance the heat transfer performance of the tube. The internal enhancement has a plurality of polyhedrons extending from the inner wall of the tubing in a preferred embodiment. In a preferred embodiment the polyhedrons are arranged in rows that are substantially parallel to the longitudinal axis of the tubes. However, the rows may be offset from the longitudinal axis up to approximately 40 degrees. The polyhedrons have first and second planar faces that are disposed substantially parallel to the polyhedral axis. The polyhedrons have third and fourth faces disposed at an angle oblique to the longitudinal axis of the tube. The resulting surface increases the internal surface area of the tube and thus increases the heat transfer performance of the tube. In addition, the polyhedrons promote flow conditions within the tube that also promote heat transfer.

The tube of the present invention is adaptable to manufacturing from a copper or copper alloy strip by roll embossing the enhancement pattern on one surface on the strip for roll forming and seam welding the strip into tubing. Such a manufacturing process is capable of rapidly and economically producing complicated, internally enhanced heat transfer tubing.

BRIEF DESCRIPTION TO THE DRAWINGS

FIG. 1 is an elevational view of the heat exchanger tube of the present invention showing a cutaway of a portion of the tube.

FIG. 2 is a perspective view of a section of the wall of the heat exchanger tube of the present invention.

FIG. 3 is a section view of the wall of the heat exchanger tube of the present invention taken through line 3—3 of FIG. 1.

DESCRIPTION OF THE PREFERRED EMBODIMENT

Figure 4:
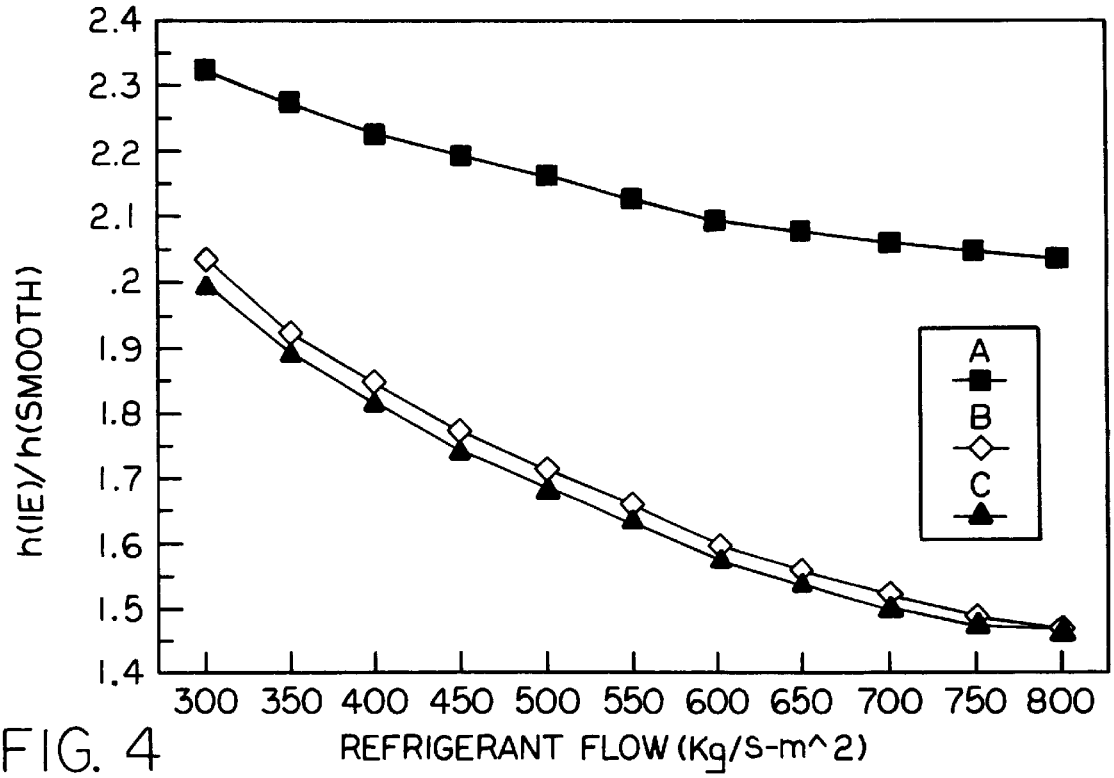
FIG. 4 is a graph showing the relative performance of the tubes of the present invention compared to a prior art tube when the tube is used in a condensing application.

Throughout this specification the term polyhedron is used and it is to be defined as a solid formed by substantially planar faces.

Referring initially to FIG. 1, tube 10 is preferably formed out of copper, copper alloy, or other heat conductive material. Tube 10 is preferably cylindrical with an outside diameter, inside diameter, and corresponding wall thickness. The inner surface is preferably formed with an internal surface enhancement 13. The heat exchanger tube 10 of the present invention is preferably formed by roll embossing the enhancement pattern 13 on one surface on a copper or copper alloy strip before roll forming and seam welding the strip into tube 10.

Turning to FIG. 2, surface enhancement 13 is shown for a portion of wall 16. Extended outward from wall 16 are a plurality of polyhedrons 19. The polyhedrons 19 are preferably disposed along the longitudinal axis of the tube 10, however they may be offset from the axis at an angle anywhere from 0 to 40 degrees. With the angle at 0 degrees, a first planar face 22 and a second planar face 25 are substantially parallel to the longitudinal axis of the tube 10. A third planar face 28 and a fourth planar face 31 are disposed at an angle oblique to the longitudinal axis. This angle of incidence between the third and fourth faces 28 and 31 and the longitudinal axis is angle $\beta$. $\beta$ can be anywhere from 5 to 90 degrees, however $\beta$ is preferably in the range of 5 to 40 degrees.

The polyhedrons 19 are disposed on the wall 16 at a distance d between centerlines of the adjacent rows. Distance d can be in the range of 0.011 inches to 0.037 inches, however, the preferred range is 0.015 inches to 0.027 inches. The maximum length of the polyhedrons 19 measured between the third and fourth faces 28 and 31 is 1. The length 1 may be from 0.005 to 0.025 inches, however, the preferred length is approximately 0.0145 inches. A recessed area 32 adjacent to the polyhedrons 19 is lowered to a depth of D. D is in the range of −0.001 to 0.001, but is preferably 0.0005 inches (where negative values indicate distance above the inner wall of the tube).

The faces 28 and 31 form an apex angle $l_1$ which is in the range of 20 to 50 degrees, and preferably approximately 44 degrees.

Turning to FIG. 3, the polyhedrons 19 have height H and have a maximum width w. The width w is in the range of 0.004 to 0.01 inches and preferably 0.0056 inches. The polyhedrons 19 have an angle $l_2$ between opposite faces 22 and 25. Angle $l_2$ is in the range of 10 to 50 degrees and is preferably approximately 15 degrees. For all sizes of tubing the number of polyhedrons per 360 degree arc is determined by the pitch or d described above.

For optimum heat transfer consistent with minimum fluid flow resistance, a tube embodying the present invention should have an internal enhancement with features as described above and having the following parameters: the polyhedral axis 99 of the polyhedrons should be disposed at an angle between 0 to 40 degrees from the longitudinal axis of the tube; the ratio of the polyhedron height H to the inner diameter of the tube should be between 0.015 and 0.04. The angle of incidence β between the longitudinal axis and the third and fourth faces 28 and 31 should be between five degrees and forty degrees. The recessed area 32 adjacent to the polyhedron 19 should preferably extend into the inner surface of the wall 16 between −0.001 and 0.001 and preferably 0.0005 inches (negative values indicating distance above the inner wall of the tube). The apex angle $l_1$ between the opposite faces 28 and 31 should be in the range of 20 to 50 degrees and preferably 44 degrees. Also, the ratio of the cross-sectional area S (shown in FIG. 3) of the space between the polyhedrons 19 to the height H of the polyhedrons 19 should be between 0.1 mm and 0.6 mm. By increasing the cross-sectional area between the polyhedrons 19, this ratio of cross-sectional area S to height increases, and the weight and resulting costs of the tubing decrease, provided that the height (H) of the polyhedron remains unchanged.

The polyhedrons 19 (best shown in FIG. 2) are formed by the material that is remaining after two patterns are embossed in the inner wall 16. The first pattern is preferably made along the longitudinal axis of the tube 10 and determines the length of the polyhedrons 19, however, as stated above, there may be an offset up to 40 degrees. The second pattern is oblique to the longitudinal axis and determines the width of the polyhedrons 19. The second pattern preferably extends farther into the inner wall 16 of the tube 10 than the first pattern. The resulting surface enhancement 13 should preferably be formed with between 2,400 and 4,400 polyhedrons 19 per square inch of the inner wall 16. Although 2,400 to 4,400 is preferred, the number can range from 2,000 to 10,000 polyhedrons per square inch.

Enhancement 13 may be formed on the interior of tube wall 16 by any suitable process. In the manufacture of seam welded metal tubing using automated high-speed processes an effective method is to apply the enhancement pattern 13 by roll embossing on one surface of a metal strip before the strip is roll formed into a circular cross section and seam welded into tube 10. This may be accomplished by positioning two roll embossing stations in sequence in a production line for roll forming and seam welding metal strips into tubing. The stations would be positioned between the source of supply of unworked metal strip and the portion of the production line where the strip is roll formed into a tubular shape. Each embossing station has a pattern enhancement roller respectively and a backing roller. The backing and pattern rollers in each station are pressed together with sufficient force by suitable means (not shown), to cause the pattern surface on one of the rollers to be impressed into the surface on one side of the strip thus forming the longitudinal sides of the polyhedrons. The third and fourth faces 28 and 31 will be formed by a second roller having a series of raised projections that press into the polyhedrons 19.

If the tube is manufactured by roll embossing, roll forming, and seam welding, it is likely that there will be a region along the line of the weld in the finished tube 10 that either lacks the enhancement configuration that is present around the remainder of the tube 10 in a circumference, due to the nature of the manufacturing process, or has a different enhancement configuration. This region of different configuration will not adversely affect the thermal or fluid flow performance of the tube 10 in a significant way.

Turning to FIG. 4, h represents the heat transfer coefficient, IE represents tubing with internal enhancements, and "smooth" represents plain tubing. The curves in FIG. 4 illustrate the relative condensing performances (h(IE)/h (Smooth)) of three different internally enhanced tubes compared to a tube having a smooth inner surface over a range of mass flow rate of refrigerant R-22 through the tubes. Tube A is one embodiment of the present invention, which has a S/H ratio of 0.264 mm, a β angle of 15 degrees, and the rows of polyhedrons oriented substantially parallel to the longitudinal axis of the tube. Tube B represents a prior art tube having helical internal ribs similar to the tube disclosed in U.S. Pat. No. 4,658,892. Tube C is another embodiment of the present invention, which has a S/H ratio of 0.506 mm, a β angle of 15 degrees, and the rows of polyhedrons oriented substantially parallel to the longitudinal axis of the tube.

The graph of FIG. 4 illustrates that Tube A outperforms Tube B, while Tube C performs approximately equal to Tube B, over a wide range of flow rates. Tube A is designed to have the same weight as Tube B, and Tube C is designed to have a lighter weight than Tube B. Accordingly, the present invention provides better performance at equal weight and equal performance at a reduced weight therefore reducing the costs to the end user.

Figure 5:
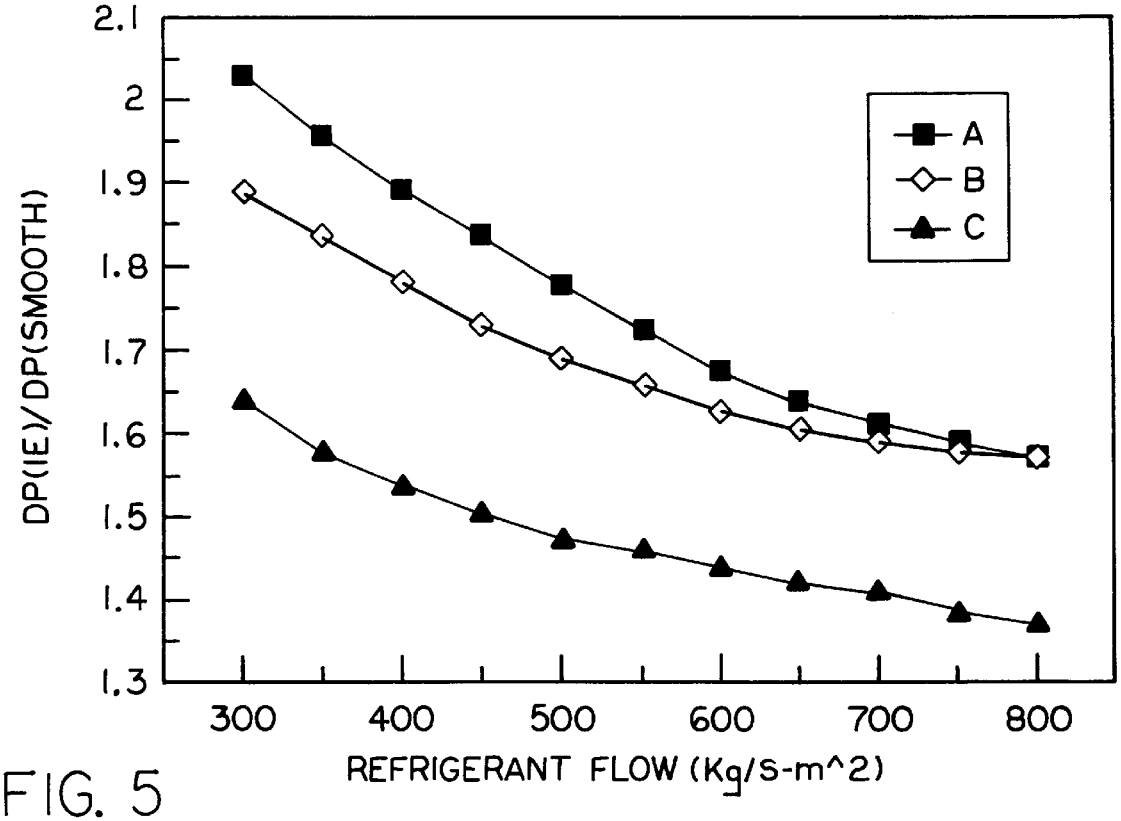
FIG. 5 is a graph showing the relative performance of the tubes of the present invention compared to a prior art tube with regard to pressure drop.

Turning to FIG. 5, the curves show the relative performance with regard to pressure drop of the above described tubes A, B, and C, over a range of mass flow rates of refrigerant R-22 through the tube. The graph of FIG. 5 indicates that tube A has a relatively small amount of increase in pressure drop, while tube C has a significant decrease in pressure drop over a wide range of refrigerant R-22 flow rates, all compared to Tube B.

Accordingly, the tube of the present invention provides superior performance for the end users without adding any significant complexity to their manufacturing processes.

While the invention has been described in connection with certain preferred embodiments, it is not intended to limit the scope of the invention to the particular forms set forth, but, on the contrary it is intended to cover such alternatives, modifications, and equivalents as may be included within the spirit and scope of the invention as defined by the appended claims.

What is claimed:

1. A heat exchanger tube, comprising:

a tubular member having an inner surface defining an inner diameter and having a longitudinal axis; and a plurality of polyhedrons formed on the inner surface along at least one polyhedral axis, the at least one polyhedral axis disposed at an angle of about 0–40 degrees with respect to the longitudinal axis, each of the polyhedrons having four opposite sides and a height, the polyhedrons having first and second faces opposed to each other, the polyhedrons having third and fourth faces opposed and inclined to each other and disposed at an angle of 5–14 degrees to the polyhedral axis, the polyhedrons defining a space between adjacent polyhedrons having a cross-sectional area (S), the ratio of the cross-sectional area to the height being 0.1 mm to 0.6 mm, the polyhedrons disposed such that there are about 2,000 to 5,000 polyhedrons per square inch of tubing, the polyhedrons having an apex angle between adjacent third and fourth faces of the polyhedrons that is about 20 to 50 degrees.

2. The heat exchanger tube of claim 1, wherein the inner surface adjacent to the third and fourth faces is recessed below the remainder of the inner surface.

3. The heat exchanger tube of claim 2, wherein the recessed portion is in the range of 0.001 inches above the inner surface to 0.001 inches below the inner surface.

4. The heat exchanger tube of claim 1, wherein the distance between adjacent rows of polyhedrons is approximately 0.011 to 0.037 inches.

5. The heat exchanger tube of claim 1, wherein there are approximately 2,400 to 4,400 polyhedrons per square inch.

6. The heat exchanger tube of claim 1, wherein the angle between adjacent first and second faces is 10 to 50 degrees.

7. A heat exchanger tube, comprising:

a tubular member having an inner surface defining an inner diameter and having a longitudinal axis;

a plurality of polyhedrons formed on the inner surface along at least one polyhedral axis, the at least one polyhedral axis disposed at an angle of 0–40 degrees to the longitudinal axis, each of the polyhedrons having four opposite sides and a height, the polyhedrons having first and second faces opposed to each other, the polyhedrons having third and fourth faces opposed and inclined to each other and disposed at an angle β of 5–14 degrees to the polyhedral axis; the polyhedrons defining a space between adjacent polyhedrons having a cross-sectional area S, the ratio of S to the height of the polyhedron being about 0.1–0.6 mm.

8. The heat exchanger tube of claim 7, wherein a portion of the inner surface adjacent to the third and fourth faces is recessed below the remainder of the inner surface.

9. The heat exchanger tube of claim 8, wherein the recessed portion is in the range of 0.001 inches above the inner surface to 0.001 inches below the inner surface.

10. The heat exchanger tube of claim 7, wherein the distance between adjacent rows of polyhedrons is approximately 0.011 to 0.037 inches.

11. The heat exchanger tube of claim 7, wherein there are approximately 2,400 to 4,400 polyhedrons per square inch.

12. The heat exchanger tube of claim 7, wherein the apex angle between adjacent third and fourth faces of the polyhedrons is 20 to 50 degrees.

13. The heat exchanger tube of claim 7, wherein the angle between adjacent first and second faces is 10 to 50 degrees.

14. A heat exchanger tube, comprising:

a tubular member having an inner surface defining an inner diameter and having a longitudinal axis; and, a plurality of polyhedrons formed on the inner surface along at least one polyhedral axis, the at least one polyhedral axis being disposed at an angle of 0–40 degrees to the longitudinal axis, each of the polyhedrons having four opposite sides and a height, the polyhedrons having first and second opposed faces and third and fourth opposed faces, the third and fourth faces each disposed at an angle β of 5–14 degrees to the polyhedral axis; the polyhedrons defining a space between adjacent polyhedrons having a cross-sectional area S, the ratio of S to the height of the polyhedron being about 0.4–0.6, the third and fourth faces having a notch disposed therebetween, the notch extending into the inner surface, the polyhedrons disposed such that there are about 2,000 to 5,000 polyhedrons per square inch of tubing, and the polyhedrons having an apex angle between adjacent third and fourth faces of the polyhedrons that is about 20 to 50 degrees.

15. The heat exchanger tube of claim 14, wherein the notch extends about 0.001 inch into the inner surface.

16. The heat exchanger tube of claim 14, wherein there are about 2400 polyhedrons per square inch.

* * * * *

UNITED STATES PATENT AND TRADEMARK OFFICE

CERTIFICATE OF CORRECTION

PATENT NO. : 6,182,743
DATED : Feb. 6, 2001
INVENTOR(S) : Bennett et al.

It is certified that error appears in the above-identified patent and that said Letters Patent is hereby corrected as shown below:

Cover page, item (73) - "Cooper" should be -- Copper --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*